US006334394B1

(12) United States Patent
Zimmermann et al.

(10) Patent No.: US 6,334,394 B1
(45) Date of Patent: Jan. 1, 2002

(54) PROPELLANT CHARGE ARRANGEMENT FOR BARREL-WEAPONS OR BALLISTIC DRIVES

(75) Inventors: Gerd Karl Werner Zimmermann, Weil am Rhien; Ernst Gütlin, Efringen-Kirchen; Hans Jürgen Maag, Koblenz, all of (DE)

(73) Assignee: Fraunhofer-Gesellschaft zur Förderung der angewandten Forschung, Munich (DE)

( * ) Notice: Subject to any disclaimer, the term of this patent is extended or adjusted under 35 U.S.C. 154(b) by 0 days.

(21) Appl. No.: 09/547,016

(22) Filed: Apr. 11, 2000

(30) Foreign Application Priority Data

Apr. 19, 1999 (DE) ..... 199 17 633

(51) Int. Cl.[7] ..... C06D 5/06; F24B 5/16

(52) U.S. Cl. ..... 102/286; 102/288; 102/289; 102/430; 102/433; 102/202; 102/202.6; 102/701

(58) Field of Search ..... 102/286, 288, 102/289, 430, 431, 443, 202.6, 202.7, 202, 701

(56) References Cited

U.S. PATENT DOCUMENTS 3,394,218 A * 7/1968 Foudriat ..... 102/286 X
3,712,225 A * 1/1973 Nimylowycz ..... 102/443 X
3,820,461 A * 6/1974 Silvia ..... 102/701 X
3,822,645 A * 7/1974 Alexander ..... 102/289
4,363,272 A * 12/1982 Simmons ..... 102/202.14 X
4,461,214 A * 7/1984 Black ..... 102/443 X
5,042,338 A * 8/1991 Warren et al. ..... 102/443 X
5,048,422 A * 9/1991 Northrup et al. ..... 102/443 X
5,323,707 A * 6/1994 Norton et al. ..... 102/431
5,443,009 A * 8/1995 Thiesen et al. ..... 102/443
5,557,059 A * 9/1996 Warren et al. ..... 102/443 X
5,612,506 A 3/1997 Yeshayahu ..... 102/472
5,672,842 A * 9/1997 Brion et al. ..... 102/431 X
6,202,560 B1 * 3/2001 Guirguis ..... 102/443 X

FOREIGN PATENT DOCUMENTS

EP 304099 * 2/1989 ..... 102/440

* cited by examiner

*Primary Examiner*—Peter A. Nelson
(74) *Attorney, Agent, or Firm*—Paul Vincent

(57) ABSTRACT

A propellant charge arrangement for barrel-weapons or ballistic drives comprises a conventional core charge having an ignition system and a consolidated propellant surrounding the core charge and having its own high electrical energy ignition system which can be controlled in a time-delayed manner after triggering the core charge ignition system. The structure and arrangement of the consolidated propellant and its ignition system are chosen such that, during combustion of the core charge, the consolidated propellant disintegrates into fragments of essentially uniform geometry in response to triggering of its associated ignition system, wherein the fragments are accelerated into the gas volume generated during combustion of the core charge.

17 Claims, 6 Drawing Sheets

PROPELLANT CHARGE ARRANGEMENT FOR BARREL-WEAPONS OR BALLISTIC DRIVES

This application claims Paris Convention priority of DE 199 17 633.7 filed Apr. 19, 1999 the complete disclosure of which is hereby incorporated by reference.

BACKGROUND OF THE INVENTION

The invention concerns a propellant charge arrangement for barrel-weapons or ballistic drives.

The performance of chemically reacting propellant charges is determined essentially by the ratio of charge mass and its energy density to the mass of the object to be accelerated (projectile or rocket). One therefore always tries to match the mass of the propellant charge and its energy density to the specific case at hand.

In addition to conventional propellant charges, recently, arrangements comprising consolidated propellants of high energy density have been examined which are triggered by means of electrical energy, e.g. in the electro-thermal chemical cannon. Ignition and combustion of such consolidated propellants is problematic, since the charge arrangement has to be broken up and disintegrated, thereby requiring defined surfaces to achieve time-controlled ignition and combustion at high propellant charge conversion speeds.

This is also the case for recently examined liquid propellant charges which have to be converted into a corresponding dispersion.

For acceleration of projectiles in barrel-weapons, combustion of the propellant charge and acceleration of the projectile is a dynamic process which occurs within an extremely short time within which the gas evolution of the propellant charge must be matched to the mass of the projectile. One must also take into consideration the fact that, with acceleration of the projectile, the volume to be filled by the propellant increases. These overlapping processes must be matched to ensure that the projectile reaches the desired muzzle velocity. In this connection, the gas-pressure/time-curve is decisive. This is generally a Gaussian curve, i.e. the pressure increases very rapidly and exponentially to a maximum pressure and drops somewhat less steeply and exponentially with increasing acceleration of the projectile towards the muzzle. The conversion speed of the propellant charge has similar characteristics with a slightly more symmetric development of the Gaussian curve. For the drive performance, the pressure/time integral is decisive and has an upper limit given by the maximum admissible gas pressure in the charging room. The ideal case would be a trapezoidal pressure development, wherein the maximum pressure and also the muzzle pressure would be smaller, with the integral of the pressure/time curve being larger.

A conventional propellant charge arrangement (U.S. Pat. No. 5,612,506) comprises an electric ignition system disposed on the axis of the propellant charge room having a central rod electrode and several wire electrodes disposed at an axial distance from one another and insulated from one another. This structurally complicated electrode is surrounded concentrically by a wire basket which accommodates a powdery ignition substance, preferably polyethylene powder. The wire basket is surrounded concentrically by the oxidator, e.g. ammonium nitrate. The electrode structure should enable plasma ignition migration from the front to the rear through the propellant charge arrangement such that the propellant gas generation approximately follows the propulsion of the projectile in the barrel-weapon to result in an approximately trapezoidal pressure/time curve. Apart from the demanding and mechanically sensitive electrode construction, this propellant charge arrangement has very low energy density due to the fuel/oxidator selection and the relatively large inactive mass of the electrode structure.

It is the underlying purpose of the invention to provide a propellant charge arrangement consisting of a core charge and a consolidated propellant surrounding the core charge, which approximates, as closely as possible, the ideal trapezoidal development of the pressure/time curve during combustion.

SUMMARY OF THE INVENTION

This object is achieved by a propellant charge arrangement comprising a core charge of conventional construction having an ignition system and with a consolidated propellant surrounding the core charge which has its own high electrical energy ignition system which can be controlled in a delayed manner after triggering the ignition system for the core charge, wherein construction and arrangement of the consolidated propellant and its ignition system are selected such that, during combustion of the core charge, the consolidated propellant is disintegrated, by the triggering of its associated ignition system, into fragments of essentially regular geometry and the fragments are accelerated into the gas volume generated during combustion of the core charge.

While the core charge and its ignition system are of conventional construction, e.g. consist of a conventional gun powder which is ignited pyrotechnically or electrically, the propellant charge surrounding it comprises a consolidated propellant having its own ignition system. The core charge is initially ignited in the conventional manner and the ignition system of the consolidated propellant surrounding same is triggered in a delayed manner. The latter is an ignition system operating with high electrical energy, wherein a large amount of plasma energy is released locally e.g. by arc discharge, which can preferably be controlled in time and/or space. The consolidated propellant is thereby disintegrated into fragments in a defined sequence. Construction of the consolidated propellant and its arrangement as well as that of the ignition system can be effected such that fragments of relatively uniform geometry are generated, which consequently have relatively uniform surfaces to effect uniform ignition and combustion. With appropriate outer insulation and arrangement of the ignition system, these fragments are accelerated into the gas volume developed during combustion of the core charge and are completely transformed therein. With e.g. a barrel-weapon, the volume increase and pressure reduction due to the acceleration of the projectile are thereby immediately compensated for. This propellant charge arrangement structure reduces the maximum pressure, while maintaining the generated maximum pressure for a longer time. Instead of a peak, the pressure/time diagram has a pressure plateau with reduced pressure levels such that the projectile is accelerated with a lower gas pressure of longer duration. Moreover, the muzzle pressure is reduced without reducing the muzzle velocity.

The formation of fragments of essentially regular geometry can be achieved e.g. by providing the consolidated propellant with an essentially uniform design structure. This can e.g. be effected by inhomogeneities of essentially uniform geometric arrangement. When the ignition system is triggered, the consolidated propellant is broken up along the inhomogeneities and accelerated towards the inside in correspondingly uniform fragments, wherein the generated surfaces provide effective ignition and combustion.

With solid charges, the inhomogeneities can be formed e.g. by bordering layers between neighboring layers of the consolidated propellant. They are preferably disposed essentially linearly in a pattern.

A structure of this type can be realized in a particularly simple manner by arranging the consolidated propellant in at least two layers, wherein the linear inhomogeneities in one layer extend at an angle, e.g. at a right angle, with respect to the linear inhomogeneities in the other layer. In this case, the consolidated propellant comprises individual strips of propellant which are separated from one another by the inhomogeneities or bordering layers, wherein the strips of the two layers disposed one on top of the other, cross each other.

Disintegration of the consolidated propellant into uniform fragments can be realized or supported when the ignition system of the consolidated propellant comprises electrical conductors associated with an essentially uniform arrangement of the consolidated propellant. The energy required for disintegration and ignition is also released in a geometrically uniformly distributed manner and supports the disintegration into uniform fragments, enabled by the structured geometry of the consolidated propellant. Moreover, the energy required for uniform ignition or uniform initial combustion is supplied by this ignition system.

The electrical conductors can be disposed e.g. in a ladder-shaped manner, wherein the conductor configuration can taper in a trapezoidal manner depending on the arrangement and design of the overall propellant charge.

The conductors can be embedded in the consolidated propellant or disposed on the surface of the consolidated propellant facing away from the core charge.

The ignition system can be improved by at least partially surrounding the electrical conductors with a pressure-generating layer of pyrotechnical material or fine-grained propellant charge powder to increase the energy locally released at the conductors.

Instead or additionally, the consolidated propellant can be surrounded, at its surface facing away from the core charge, by a gas-generating layer of pyrotechnical material or fine-grained propellant charge powder, wherein the electrical conductors are preferably embedded in this layer. A further peripheral pressure component with isostatic effect is thereby generated to support disintegration and acceleration of the fragments as well as their ignition and combustion.

In a further embodiment, the at least two layers of the consolidated propellant have variable transparency to optimally utilize and precisely control the radiative energy generated during arc discharge. For example, that layer of the consolidated propellant into which the electrical conductors are embedded or on which they are disposed, can have a higher transparency than the subsequent layers in the direction of the core charge.

The arc discharges generated along the conductor paths at defined spatial and time intervals and the high temperature plasmas generated thereby, break up the structured consolidated propellant in a defined and reproducible manner such that ignition and combustion of the disintegrated consolidated propellant occurs at predetermined locations and times. This is done at a defined time following combustion of the core charge. The higher conversion speed of the consolidated propellant compensates for the volume increase during acceleration of the projectile as well as for pressure reduction in the charging room. The high gas pressures associated with high temperature plasma generation and with ignition and combustion of the consolidated propellant fragments overlap, in a time-delayed manner, with the gas pressure curve of the core charge to increase drive performance. The conversion speed can be increased by radiation transport from the high temperature plasmas and by appropriately layered transparency or radiative absorptivity.

The invention is described below using embodiments shown in the drawing.

DESCRIPTION OF THE PREFERRED EMBODIMENT

Figure 1:
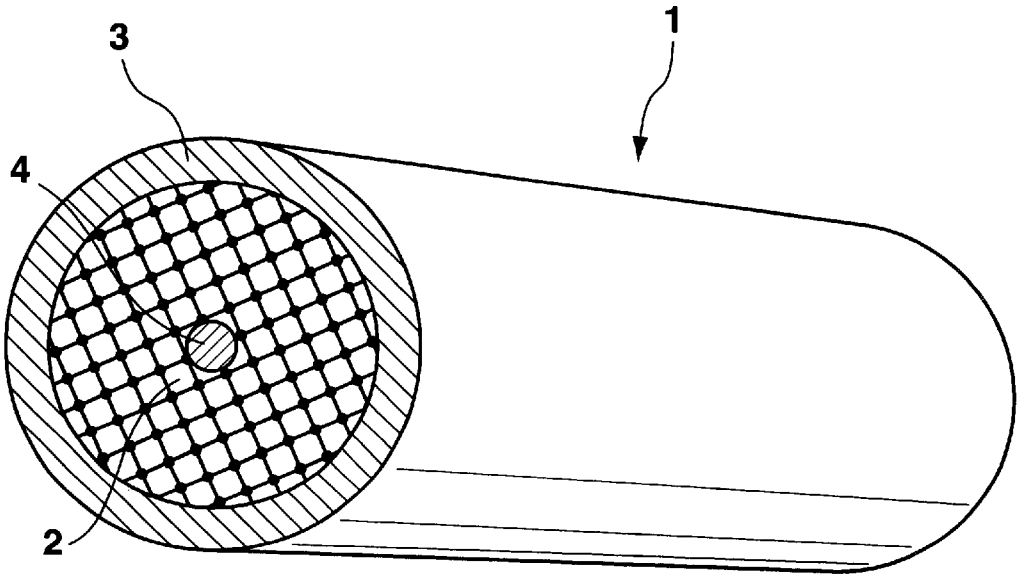
FIG. 1 shows a perspective view of a first embodiment of the propellant charge arrangement.
Figure 2:
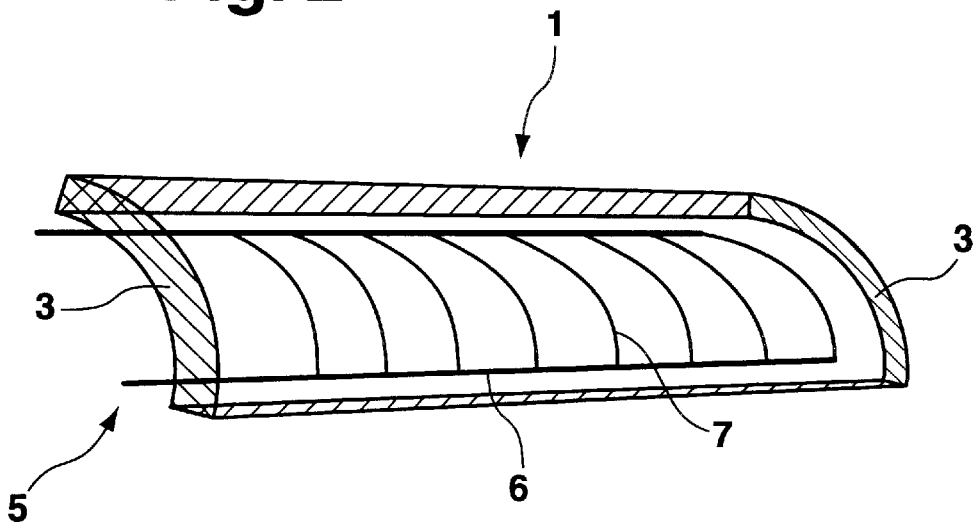
FIG. 2 shows a sector-shaped section of the consolidated propellant of the arrangement in accordance with FIG. 1.

The propellant charge arrangement 1 has a cylindrical shape. It comprises a core charge 2 and a consolidated propellant 3 surrounding same. The core charge 2 is of conventional construction, e.g. comprising gun powder. The core charge 2 also has an ignition system 4 comprising a centrally disposed pyrotechnical charge (in the embodiment according to FIG. 1) or in the form of an electrical system.

The outer consolidated propellant 3 has its own ignition system 5 comprising e.g. ladder-shaped electrical conductors 6, 7 which are fed with high voltage via triggered spark gaps to generate arc discharges distributed in time and space for formation of a high temperature plasma.

Figure 3:
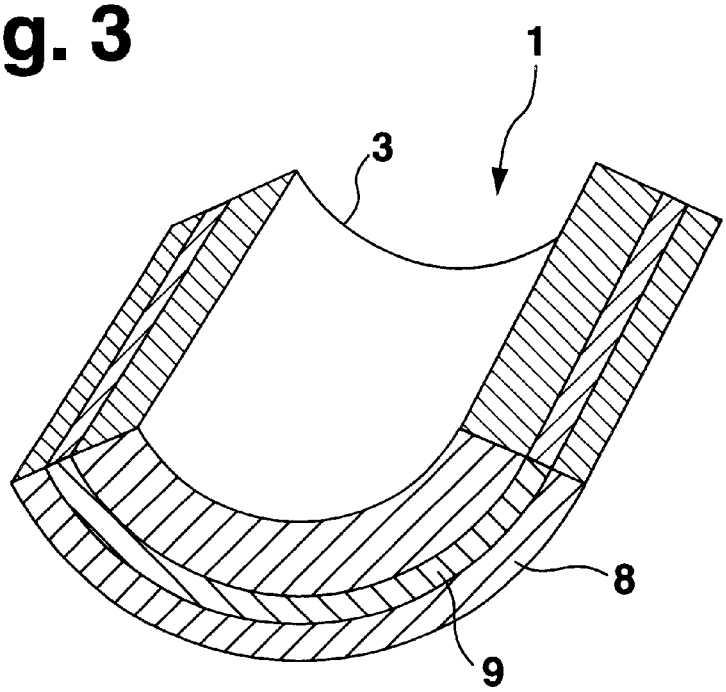
FIG. 3 shows a sector-shaped section of a further embodiment of the consolidated propellant.
Figure 4:
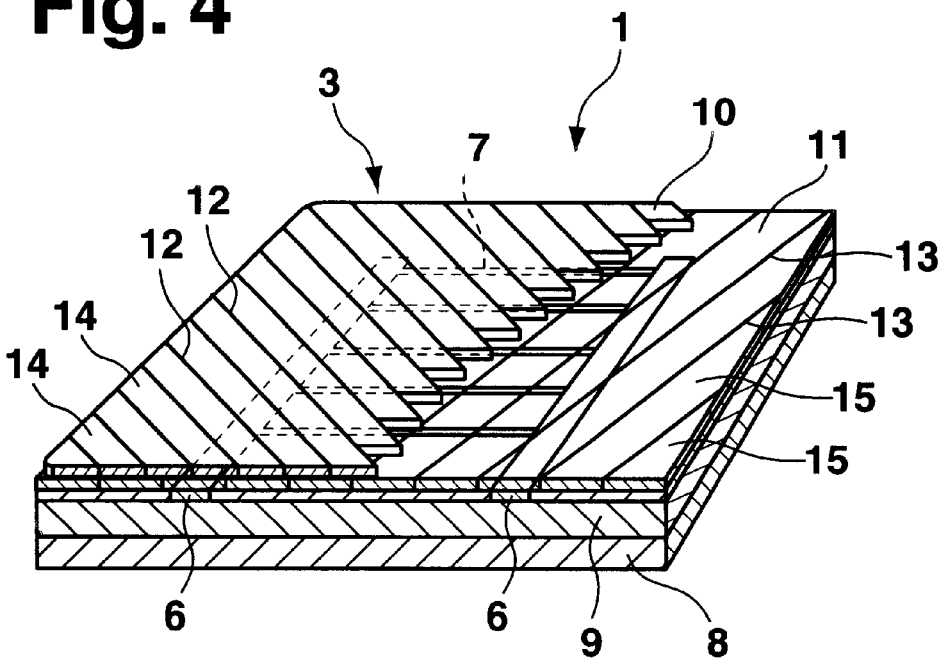
FIG. 4 shows a detailed flat, unfolded view of the embodiment in accordance with FIG. 3.

FIGS. 3 and 4 more clearly show the structure proximate the consolidated propellant. The consolidated propellant 3 is disposed inside the wall 8, e.g. of a barrel-weapon with an intermediate insulation layer 9. The consolidated propellant comprises two layers 10, 11. The electrical conductors 6, 7 are disposed between the outer layer 11 and the insulating layer, peripherally on the outer layer 11. The two layers 10 and 11 comprise linear inhomogeneities 12 or 13 generated e.g. by forming each layer 10, 11 from neighboring propellant strips 14 or 15.

Figure 5:
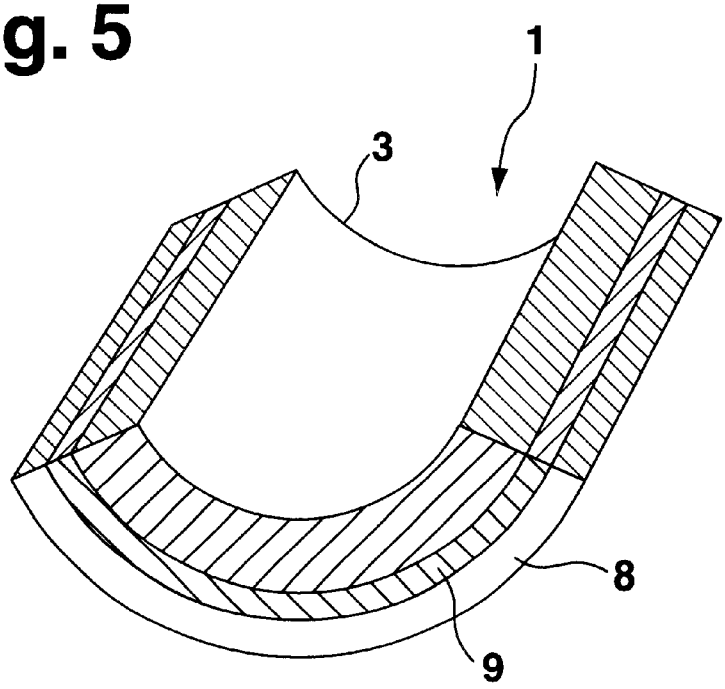
FIG. 5 shows a section of a further embodiment of the consolidated propellant, similar to FIG. 3.
Figure 6:
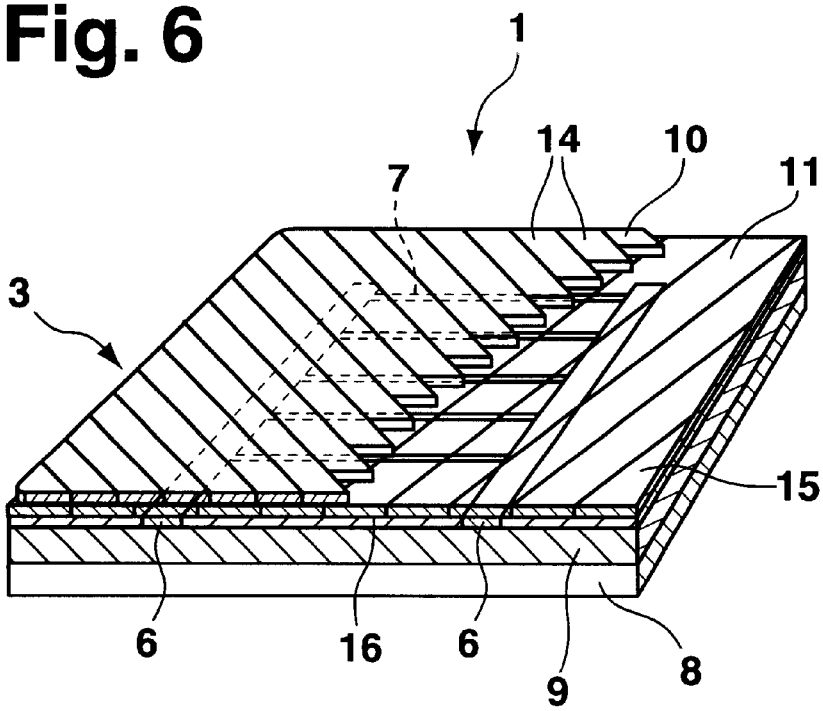
FIG. 6 shows a flat unfolded view of FIG. 5, with detailed illustration of the structure.

The embodiment in accordance with FIGS. 5 and 6 differs from that of FIGS. 3 and 4 only in that a pressure-amplifying layer 16, e.g. of pyrotechnical material or propellant charge powder is disposed between the insulating layer 9 and the consolidated propellant 3 in which the electrical conductors 6, 7 of the ignition system are completely or partially embedded.

Figure 7:
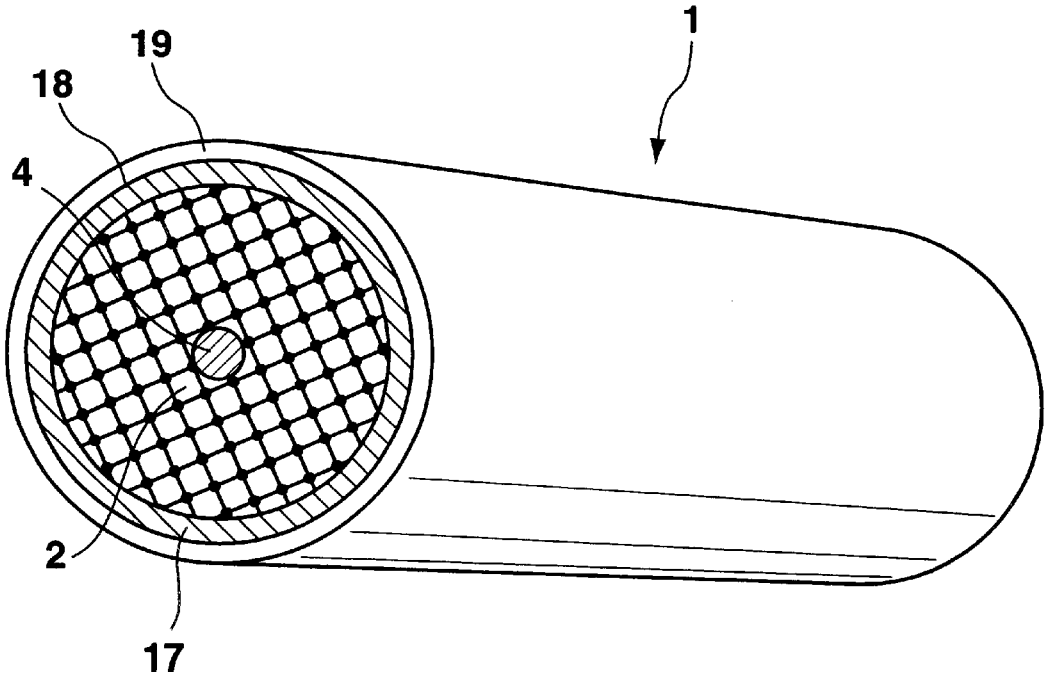
FIG. 7 shows a perspective view of a further variant of the propellant charge arrangement.
Figure 8:
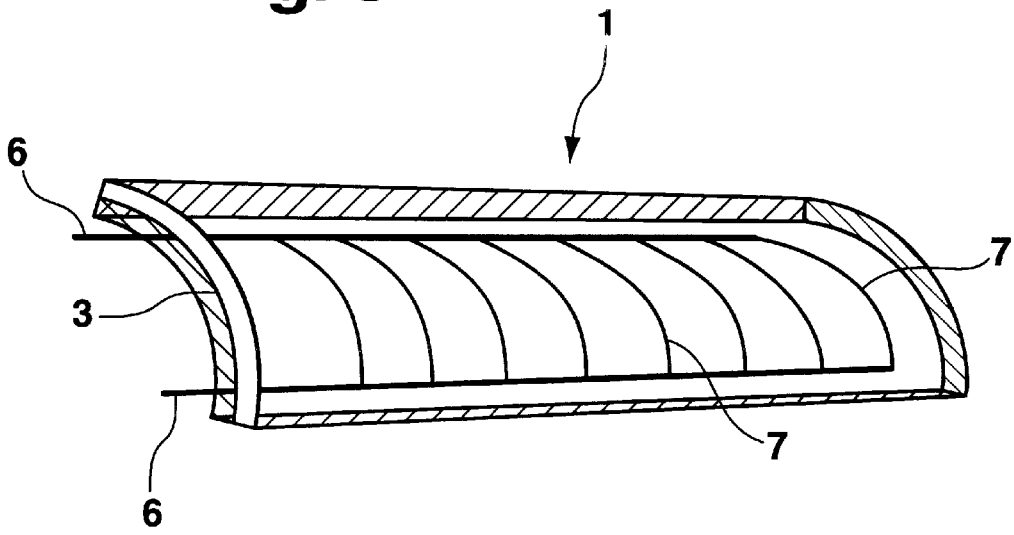
FIG. 8 shows a sector-shaped section of the consolidated propellant for the propellant charge arrangement of FIG. 7.

In the embodiment in accordance with FIGS. 7 and 8, the propellant charge arrangement 1 comprises a core charge 2 with ignition system 4 corresponding to the embodiment according to FIG. 1. However, the consolidated propellant comprises liquid propellants and has an inner charge 17 and an outer charge 19 separated from each other by a bordering layer 18. The bordering layer 18 constitutes the ignition system, having conductors 6, 7. In this embodiment, the outer liquid charge 19 has a larger transparency than the inner liquid charge 17.

Figure 9:
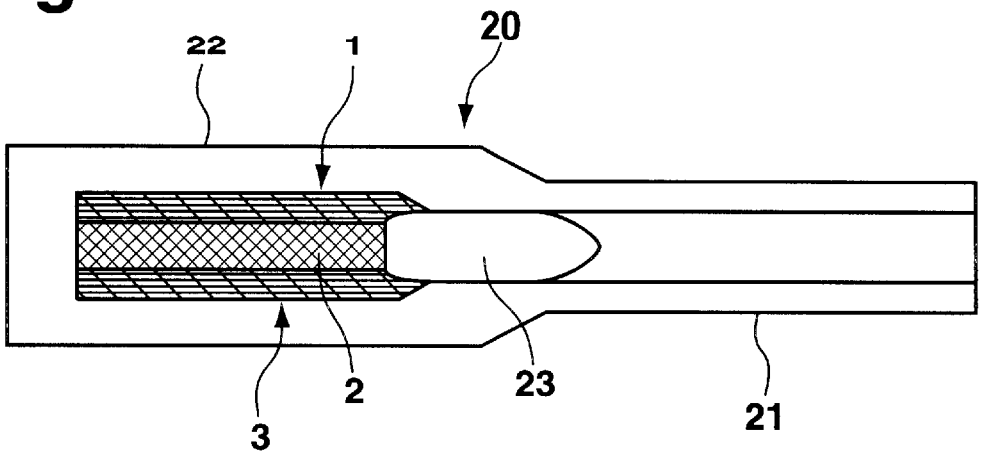
FIG. 9 shows a first phase of an example of use of the propellant charge arrangement in barrel-weapons.
Figure 10:
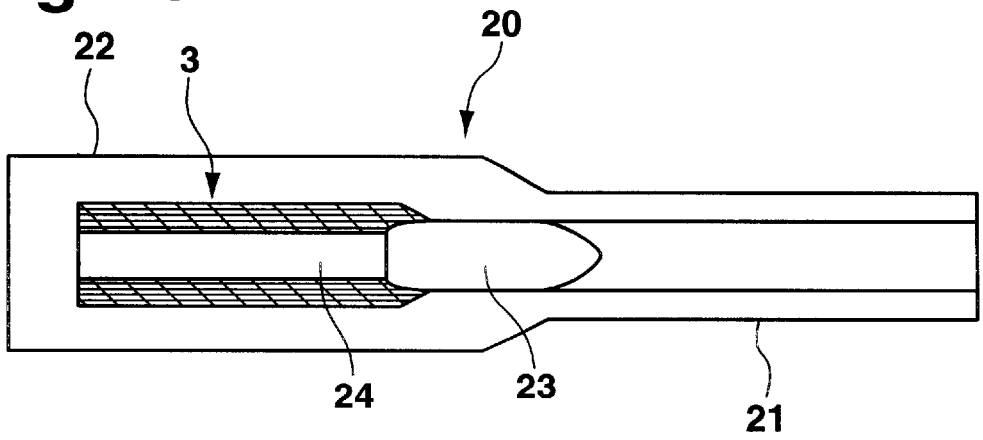
FIG. 10 shows a second phase of an example of use of the propellant charge arrangement in barrel-weapons.
Figure 11:
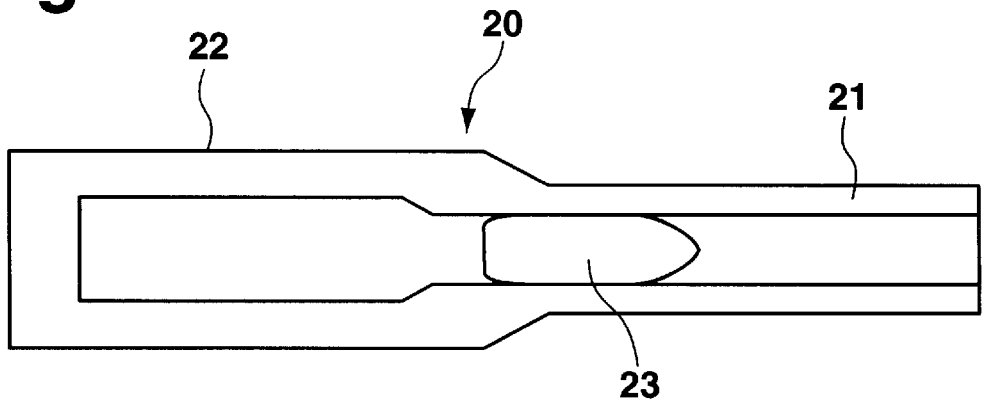
FIG. 11 shows a third phase of an example of use of the propellant charge arrangement in barrel-weapons.

FIGS. 9 to 11 show various phases during combustion of the propellant charge arrangement 1 in a schematically illustrated barrel-weapon. The barrel-weapon 20 comprises a barrel 21 and a charging room 22 in which the propellant charge arrangement 1 is accommodated. The propellant charge arrangement comprises the conventional core charge 2 and the consolidated propellant 3 surrounding same. A projectile 23 is disposed in the barrel and its rear extends into the propellant charge room 22. As shown in the figure, the propellant charge room 22 has a larger inner cross-section than the cross-section of the projectile 23 and the cross-section of the core charge 2 is somewhat smaller than that of the projectile 23. The outer cross-section of the consolidated propellant 3 is, however, larger and fills the propellant charge room. After ignition of the core charge 2 and conversion of the solid propellant into the gaseous phase 24, the projectile 23 begins to accelerate. The outer consolidated propellant 3 is ignited in a time-overlapping, possibly sequential manner and is disintegrated into fragments, the fragments being accelerated into the gas volume 24. At the same time, ignition and conversion of the propellant fragments of the consolidated propellant 3 begins. The projectile 23 experiences a uniform, approximately constant pressure along a relatively long path and leaves the barrel 21 with the desired high muzzle velocity at reduced muzzle pressure.

Figure 12:
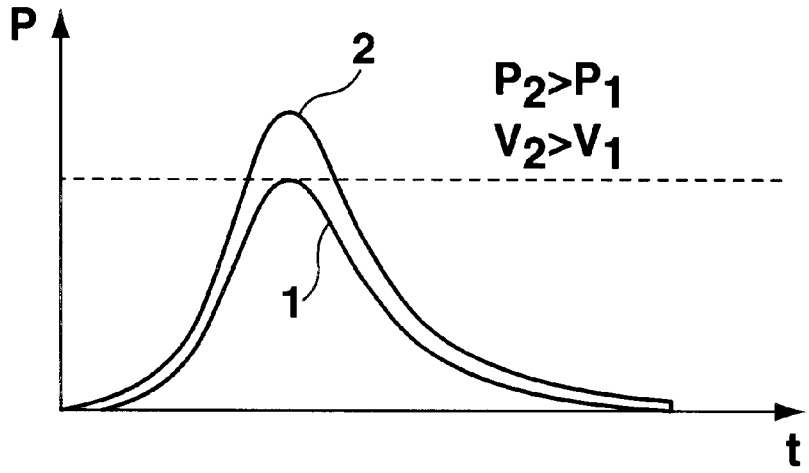
FIG. 12 shows a pressure/time diagram of various propellant charges with separate ignition.
Figure 13:
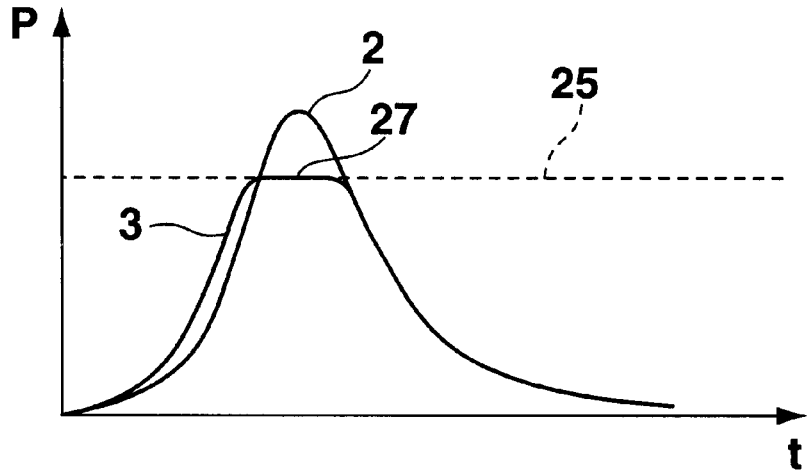
FIG. 13 shows a pressure/time diagram of the propellant charge arrangement in accordance with the invention.

FIG. 12 shows the pressure-time dependence for two propellant charges of different construction, e.g. for a conventional propellant charge (curve 1) and for a consolidated propellant (curve 3). The propellant charge arrangement in accordance with the invention generates the pressure development of curve 3 and shows a marked pressure plateau 27 with a time-delayed pressure decrease having a lower maximum pressure 25 and a slightly advanced rise.

We claim:

1. A propellant charge arrangement for barrel-weapons or ballistic drives, the propellant charge arrangement comprising:

a conventional core charge;

a core charge ignition system communicating with said core charge to combust said core charge for production of a core charge gas volume;

a consolidated propellant disposed about said core charge;

a consolidated propellant electrical energy ignition system; and means for time-delayed triggering of said consolidated propellant ignition system following triggering of said core charge ignition system, wherein said consolidated propellant and said consolidated propellant ignition system are structured and disposed to disintegrate said consolidated propellant into fragments of substantially uniform geometry in response to triggering of said consolidated propellant ignition system, said fragments being accelerated into said core charge gas volume.

2. The propellant charge arrangement of claim 1, wherein said consolidated propellant has an essentially uniformly structured design.

3. The propellant arrangement of claim 1, wherein said consolidated propellant comprises inhomogeneities having a substantially uniform geometrical arrangement.

4. The propellant charge arrangement of claim 3, wherein said inhomogeneities comprise bordering interruptions between adjacent portions of said consolidated propellant.

5. The propellant charge of claim 4, wherein said inhomogeneities are disposed in a substantially linear pattern.

6. The propellant charge arrangement of claim 1, wherein said consolidated propellant is disposed in a first and a second layer, with first linear inhomogeneities in said first layer extending at angles with respect to second linear inhomogeneities in said second layer.

7. The propellant charge arrangement of claim 6, wherein said angles are approximately equal to 90 degrees.

8. The propellant charge arrangement of claim 1, wherein said consolidated propellant ignition system comprises electrical conductors which cooperate with said consolidated propellant in substantially regular disposition.

9. The propellant charge arrangement of claim 8, wherein said electrical conductors are disposed in a ladder-shaped manner.

10. The propellant charge arrangement of claim 8, wherein said electrical conductors are embedded in said consolidated propellant.

11. The propellant charge arrangement of claim 8, wherein said electrical conductors are disposed on a surface of said consolidated propellant facing away from said core charge.

12. The propellant charge arrangement of claim 8, further comprising a pressure-generating layer having one of a pyrotechnical material and fine-grained propellant charge powder, said pressure generating layer disposed to at least partially surround said electrical conductors.

13. The propellant charge arrangement of claim 8, further comprising a gas-generating layer having one of a pyrotechnical material and a fine-grained propellant charge powder, said gas-generating layer surrounding said consolidated propellant at a surface thereof facing away from said core charge.

14. The propellant charge arrangement of claim 13, wherein said electrical conductors are disposed in said gas-generating layer.

15. The propellant charge arrangement of claim 6, wherein said first layer has a first transparency which differs from a second transparency of said second layer.

16. The propellant charge arrangement of claim 15, wherein said consolidated propellant ignition system is disposed proximate to said first layer and wherein said first transparency is greater than said second transparency.

17. The propellant charge arrangement of claim 1, further comprising a wall surrounding the propellant charge arrangement and an insulating layer disposed between said consolidated propellant and said wall.

* * * * *